United States Patent [19]

Claude

[11] 3,940,038

[45] Feb. 24, 1976

[54] WATCH-BRACELET

[76] Inventor: Georges Bernard Claude, 59, rue du Progres, 2300 La Chaux-de-Fonds, Switzerland

[22] Filed: Oct. 25, 1974

[21] Appl. No.: 518,069

[30] Foreign Application Priority Data

Nov. 16, 1973 Switzerland ..... 16136/73

[52] U.S. Cl. ..... 224/4 J; 59/79 R; 224/4 K

[51] Int. Cl.[2] ..... F16G 13/18

[58] Field of Search ..... 59/80, 82, 79 R; 63/4, 63/5 R, 5 A, 8, 11; 224/4 B, 4 D, 4 H, 4 J, 4 K

[56] References Cited

UNITED STATES PATENTS

| | | | |
|---|---|---|---|
| 1,426,885 | 8/1922 | Levy | 59/80 |
| 1,784,451 | 12/1930 | Kraemer | 59/80 |

FOREIGN PATENTS OR APPLICATIONS

| | | | |
|---|---|---|---|
| 1,160,226 | 12/1963 | Germany | 224/4 J |
| 338,992 | 7/1959 | Switzerland | 63/11 |
| 338,993 | 7/1959 | Switzerland | 63/8 |

*Primary Examiner*—C. W. Lanham
*Assistant Examiner*—Gene P. Crosby
*Attorney, Agent, or Firm*—Stevens, Davis, Miller & Mosher

[57] ABSTRACT

A watch bracelet, the arms of which comprise a series of links hinged to one another and each having an arched profile with a downwardly-opening longitudinal recess, thereby defining a groove extending along the series of links of each arm. A curved blade-spring lies against the bottom of each of these grooves for urging the arms to curl up. The first link of each arm is attached to a watch-case, and the urging action of the blade-springs in the arms causes the latter to tend to hug a wearer's wrist elastically so that no clasp is required.

8 Claims, 3 Drawing Figures

FIG. 1
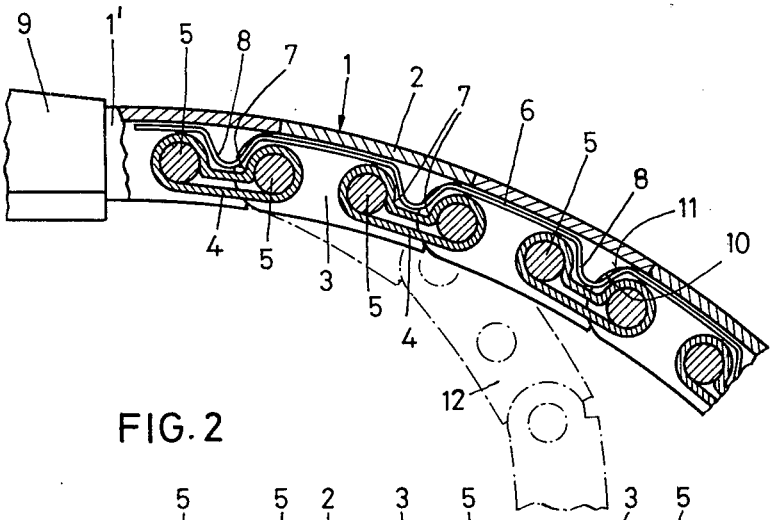
FIG. 2
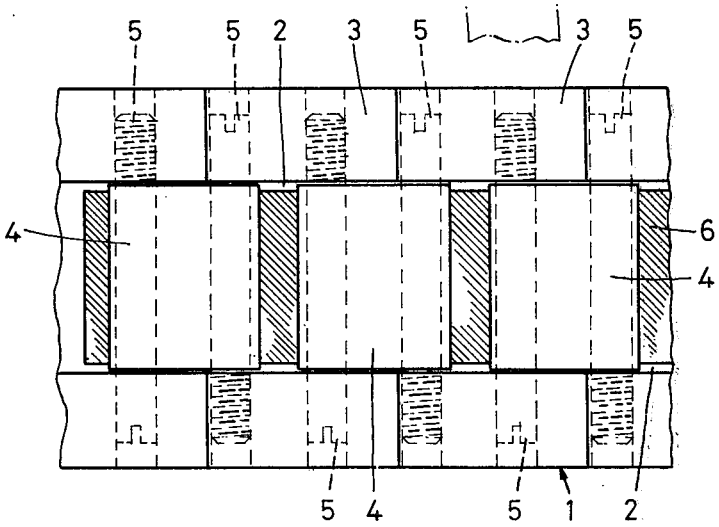
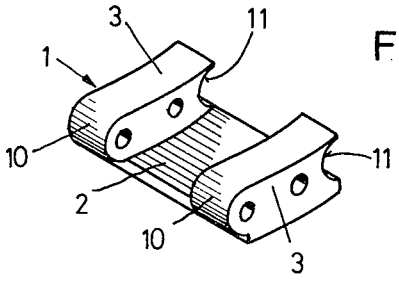
FIG. 3

WATCH-BRACELET

This invention relates to a watch-bracelet adapted to be attached to a watch-case and having two arms, each arm comprising a series of links hinged to one another, each link having a transverse profile in the shape of an arch and at least one longitudinal recess which opens downwardly and is open at each end of the link, the alignment of the recesses forming a groove extending longitudinally under the series of links of each arm.

Watch-bracelets of this type are normally equipped with a clasp and, in most cases, with shortening links, so that they may be comfortably tightened about the wearer's wrist. However, the bracelet-manufacturing industry is continually seeking new designs whcich combine, if possible, the advantages of increased practicality, attractiveness, simplicity, and inexpensiveness. One type of bracelet which has always been favoured for certain ladies' wrist-watches is the "marquise" design, which hugs the wrist merely by its elasticity, has no clasp, and naturally has no provision for adjustment in length since there is no need to adapt it to the circumference of the wrist. On the other hand, marquise bracelets, which comprise two rigid arms, have the drawback of not always being adapted to the shape of the particular wearer's wrist, and it is sometimes necessary to provide an assortment of arms having more or less pronounced curvatures depending, for example, upon the average size of the inhabitants of the country to which the bracelets are to be exported.

It is the object of this invention to provide a simple and attractive watch-bracelet of a novel kind, particularly one which adapts itself to the shape of the wrist just as well as does a classic metal bracelet having links and a clasp, but which also offers the advantages of a marquise bracelet, i.e., the absence of a clasp, convenience in use, and to a certain extent, the particular esthetic effect.

To this end, the watch-bracelet according to the present invention further comprises a blade-spring lying against the bottom of each groove and retaining means disposed under each blade-spring between the arch-sides of the links, each blade-spring having a curvature such that it urges the respective arm to curl up, the first link of each arm or one end of each blade-spring being attached to the watch-case so that the two arms tend to hug a wearer's wrist elastically in the absence of a clasp.

In a particularly preferred embodiment of the invention, the arch-sides of the links end on the one side in a concave surface of revolution and on the other side in a convex surface of revolution adapted to engage in the corresponding concave surface of revolution of the adjacent link, and connecting elements are disposed in the arches of the links, each element being fitted between the arch-sides of a link, behind the concave surface of revolution of the arch-sides, and pivoted between the arch-sides of the adjacent link at the center of its convex surface of revolution so as to join the concave and convex surfaces of revolution respectively, of two adjacent links, the connecting elements also constituting the retaining means, and each blade-spring being disposed between the bottom of the respective groove and the connecting elements.

In embodiments comprising the aforementioned connecting elements or other at least partially analogous connecting elements, in order to ensure a fitting of the spring which is both sturdy and elastic, these connecting elements further comprise, between two transverse passages intended to enable them to be mounted by means of parts forming pins in two adjacent links, a transverse elongated depression in the surface facing the spring, the spring having undulating portions which enter into the depressions, thus both holding the spring in place and giving it a certain elasticity of extension.

In order that the connecting elements may be produced simply and efficiently, they preferably consist of pieces, the length of which corresponds to the width of the element, of a tubular section, the profile of which comprises two arcs of a circle of approximately 270° connected by a first substantially straight connecting line tangent to respective ends of the two arcs, and by a second, shorter connecting line joining the other ends of the two arcs approximately where they would meet an imaginary straight line joining their respective centers, so that the elongated depression is defined, in profile, by the second connecting line and a portion of each arc.

A preferred embodiment of the invention will now be described in detail with reference to the accompanying drawing, in which:

FIG. 1 is a longitudinal sectional view of a portion of a watch-bracelet arm provided with a spring urging it to curl up, FIG. 2 is a developed inverted-plan view of the bracelet portion shown in FIG. 1, and FIG. 3 is a perspective view showing the archshape of the main part of a link (turned over for purposes of better illustration) of the bracelet in question.

It will be seen in the drawing that the bracelet to be described here comprises arch-shaped links 1, each having an upper face 2 and two side portions 3. Between the side portions 3, connecting elements 4 are mounted by means of screws 5 (or, as a variation, by means of pins) and pivoted by means of identical screws (or pins) between the ends of the side portions 3 of the adjacent link 1. This assembly ensures that corresponding cylindrical surfaces, viz., a convex surface 10 and a concave surface 11, respectively, situated at the ends of the side portions 3 of the links 1, will be engaged in such a way as to allow one link to pivot with respect to the other. It will be understood that the screws 5 which pass through bores in the side portions 3 at the center of the convex surfaces 10 make possible a relative pivoting motion, whereas the screws 5 which pass through bores in the links 1 behind the concave surfaces 11 do not, strictly speaking, make possible a pivoting motion, for the engagement of the surfaces 10 and 11 does not allow the connecting element 4 to rotate about that screw 5. For this reason, the connecting elements 4 are said to be mounted in a link 1 behind its concave surfaces 11 and to be pivoted in the other link 1 at the center of its convex surfaces 10. As a matter of fact, the connecting elements 4 might be mounted in the links 1, behind the concave surfaces 11, otherwise than by means of a transverse screw or pin.

It will be noted that whereas the connecting elements provided in certain previously known watch-bracelets were studs, the connecting elements 4 of the bracelet described here are pieces cut from a section having the shape shown in FIG. 1. The connecting elements 4 thus cut from a tubular section having two almost closed cylindrical portions are very simple to manufacture and hence advantageous to use in a bracelet such as the one illustrated.

In FIGS. 1 and 2, it will be seen that a blade-spring 6 is inserted between the backs of the arches forming the links 1 (i.e., the undersides of the upper faces of the links 1) and the connecting elements 4. This spring 6 has a certain curvature which it tends to impart to the whole series of links 1 forming an arm of the bracelet, so that this arm has a tendency to curl up. In FIG. 1, the arm is illustrated as it would appear if held open by a force counteracting the action of the spring 6; the dot-dash lines designated as 12, however, show the position normally assumed by the arm when left to itself, under the effect of the spring 6.

It should be noted that the first link 1' is rigidly secured to a watch-case 9 by soldering, by screws, or by any other suitable means. Thus a bracelet arm such as the one of which only a portion is shown in FIG. 1 is connected to each side of the watch-case, and the result is an assembly of watch-case and watch-bracelet adapted to hug the wrist of the wearer of the watch solely by means of the action of the two springs 6 (one in each arm) without any clasp means having to be provided between the two free ends of the arms remote from the watch-case. Thus a watch equipped with the bracelet described here is worn on the wrist in the same manner as a watch with a marquise bracelet, but with the added advantage —not to be found in a true marquise bracelet —of allowing the resiliently flexible bracelet to be adapted to varying wrist curvatures. It should be noted that FIG. 1 illustrates a portion of a bracelet arm on a scale approximately five to six times that of actual size.

Instead of rigidly securing the first link 1' to the watch-case, it would also be possible, as a variation, to hinge this first link to the watch-case as well; the spring 6 itself would then have to be anchored or fixed to the watch-case in a suitable manner.

It will be seen that in FIG. 1, the blade-spring 6 is formed with undulating portions 8 extending towards the bottom of the bracelet and engaging in elongated depressions 7 disposed transversely on the tops of the connecting elements 4 between the two bulbous portions of those elements through which the screws 5 pass. The presence of these undulating portions 8 thus engaged in the transverse depressions 7 presents a dual advantage: first, it gives added sturdiness to the mounting of the spring 6 in the bracelet arm, and second, it allows the spring 6 a certain elasticity of extension which is necessary when the links 1 pivot with respect to one another. If the undulating portions 8 were not provide, i.e., if the blade-spring 6 were simply formed with a continuous curvature, the spring 6 would have to slide slightly between the top 2 of the links 1 and the connecting elements 4 when the links 1 pivot with respect to one another. This would not prevent the bracelet from performing its function correctly, since the continuously curved spring could, in fact, slide; but the design illustrated in FIG. 1, with the undulating portions 8 entering the depressions 7, gives the bracelet arm more favorable characteristics of flexibility and resiliency. If the connecting elements should not have the profile shown in FIG. 1, but should take the form of studs, for example, the depressions 7 might be hollowed out of the studs in order to make it possible to mount a blade-spring having undulating portions similar to the portions 8.

Finally, it may be mentioned that the use of connecting elements cut from a tubular section such as that shown in FIG. 1 might prove to be advantageous in itself, also for a bracelet in which the arms were not equipped with a spring urging then to curl up. Moreover, the two links 1' by means of which the respective arms are attached to the watch-case might be made in a single piece having a particular configuration, a middle portion of which would be adapted to be secured to the watch-case by any suitable means. It will be obvious that other embodiments would likewise be possible within the frame work of the concept which has been described, particularly embodiments where each arm might comprise a number of springs, either superposed at least paritally or side by side, e.g., in a case where the links would comprise two parallel arches (reclining E-profile). It would also be possible to arrange the springs so as to give the arms of the bracelet more pronounced resiliency at certain points along their length and less pronounced resiliency at other points.

What is claimed is:

1. A watch-bracelet adapted to be attached to a watch-case and having two arms, each said arm comprising a series of links hinged to one another, each said link having a transverse profile in the shape of an arch and at least one longitudinal recess which opens inwardly and is open at each end of said link, the alignment of said recesses forming a groove extending longitudinally under said series of links of each said arm, said watch-bracelet further comprising a blade-spring lying against the bottom of each said groove and retaining means disposed under each said blade-spring between the arch-sides of said links, each said blade-spring having a curvature such that it urges the respective said arm to curl up, the first said link of each said arm being attached to said watch-case.

2. A watch-bracelet in accordance with claim 1, further comprising connecting elements adapted to pivot at least partially between said arch-sides of two adjacent said links and acting as a hinge between said adjacent links, said connecting elements further constituting said retaining means, and each said blade-spring being disposed between said bottom of each said groove and said connecting elements.

3. A watch-bracelet in accordance with claim 2, wherein said arch-sides end on the one side in a concave surface of revolution and on the other side in a convex surface of revolution adapted to engage in the corresponding said concave surface of revolution of the adjacent said link, and said connecting elements are disposed in said arches, each said element being fitted between said arch sides of a said link, behind said concave surface of revolution of said arch-sides, and pivoted between said arch-sides of said adjacent link at the center of its convex surface of revolution so as to join the said concave and convex surfaces of revolution, respectively, of two said adjacent links.

4. A watch-bracelet in accordance with claim 2 wherein each said connecting elements comprises two transverse passages, pin-forming parts disposed in two adjacent said links and passing through said passages for mounting said connecting elements, and a transverse elongated depression situated between said passages in the surface of said connecting element facing said blade-spring, and wherein said blade-spring comprises undulating portions entering each said depression for holding said blade-spring in place and imparting to it a certain elasticity of extension.

5. A watch-bracelet in accordance with claim 4, wherein said connecting elements consist of pieces of a tubular section, the length of said pieces corresponding to the width of said elements, and the profile of said section comprising two arcs of a circle of approximately 270° connected by a first substantially straight connecting line tangent to respective ends of said two arcs, and by a second, shorter connecting line joining the other ends of said two arcs approximately where said other ends would meet an imaginary straight line joining their respective centers, so that said elongated depression is defined, in profile, by said second connecting line and a portion of each said arc.

6. A watch-bracelet in accordance with claim 3, wherein said connecting elements consist of pieces of a tubular section, the length of said pieces corresponding to the width of said elements, and the profile of said section comprising two arcs of a circle, the ends of said arcs being joined by connecting lines.

7. A watch-bracelet in accordance with claim 6, wherein said connecting elements are pieces of a section, the profile of said section comprising two arcs of a circle of approximately 270°, the ends of said arcs being connected by connecting lines disposed so that the outer contour of said profile comprises at least one recessed portion formed by one of said connecting lines and by a portion of at least one said arc, said recessed portion defining a transverse elongated depression in a surface of each said connecting element.

8. A watch-bracelet in accordance with claim 7, wherein said blade-spring comprises undulating portions entering each said depression for holding said blade-spring in place and imparting to it a certain elasticity of extension.

* * * * *